US005223049A

United States Patent [19]

Urita et al.

[11] Patent Number: 5,223,049

[45] Date of Patent: Jun. 29, 1993

[54] STEEL FOR INDUCTION HARDENING

[75] Inventors: Tatsumi Urita, Tokai; Kunio Namiki, Nagoya, both of Japan

[73] Assignees: Daido Tokushuko Kabushiki Kaisha, Nagoya; NTN Corporation, Osaka, both of Japan

[21] Appl. No.: 789,568

[22] Filed: Nov. 8, 1991

[30] Foreign Application Priority Data

Nov. 16, 1990 [JP] Japan ..... 2-310627

[51] Int. Cl.[5] ..... C22C 38/06; C22C 38/14

[52] U.S. Cl. ..... 148/330; 420/121; 420/84

[58] Field of Search ..... 148/330; 420/121, 84

[56] References Cited

FOREIGN PATENT DOCUMENTS 5465115 5/1979 Japan ..... 148/330

645977 2/1979 U.S.S.R. ..... 148/330

*Primary Examiner*—Deborah Yee

*Attorney, Agent, or Firm*—Varndell Legal Group

[57] ABSTRACT

A steel having such a good machinability that it can be directly cut without being annealed and a good induction hardenability. The steel consists essentially of C: 0.37–0.45%, Si: up to 0.35%, Mn: more than 1.0% - up to 1.5%, B: 0.0005–0.0035%, Ti: 0.01–0.05%, Al: 0.01–0.06% and the balance of Fe, the content of N being up to 0.022 and has a fine structure of ferrite crystal grain size number 6 or more as defined by JIS-G0552. In addition to the above basic composition, the alloy may further contain some optional alloying elements.

The material is suitable for manufacturing machine structural parts such as drive shafts of automobiles.

8 Claims, No Drawings

STEEL FOR INDUCTION HARDENING

BACKGROUND OF THE INVENTION

1. Field of the Invention

The present invention concerns a steel for induction hardening, more specifically, a steel which can be processed as rolled without being annealed by cutting or form rolling and is suitable for induction hardening.

2. State of the Art

Taking a drive shaft with a homokinetic joint for automobiles as an example, it is manufactured in accordance with the steps of annealing or spheroidal annealing a steel for rolling such as SAE1541 to increase the machinability thereof, processing the steel by cutting or form rolling and strengthening the surface by induction hardening.

The SAE1541 steel, however, has poor machinability as rolled, and therefore, it is difficult to process the steel without heat treatment. Thus, this steel is not a suitable material from an economical point of view.

As the automobiles are getting more light-weighted and high-powered, the drive shafts should have higher strength. On the other hand, it is demanded that annealing be eliminated to enable direct cutting of the rolled steel at the request of cost reduction. To meet the request, there was proposed a steel having a composition in which manganese content of the SAE1541 steel is reduced to improve the machinability. The steel, however, has a drawback that the induction hardenability is low and the depth of surface hardened layer fluctuates.

SUMMARY OF THE INVENTION

The object of the present invention is to provide a steel for induction hardening which has such a good machinability that it can be directly cut without being annealed as well as a good induction hardenability and thus, contributes to the improvement in strength of machine structural parts.

The steel for induction hardening of the present invention consists essentially of the alloying elements: C: 0.37–0.45%, Si: up to 0.35%, Mn: more than 1.0% up to 1.5%, B: 0.0005–0.0035%, Ti: 0.01–0.05%, Al: 0.01–0.06%; and the balance of Fe; the content of N being up to 0.22%; and is characterized by the fine structure of ferrite crystal grain size number 6 or more defined by JIS-G0552.

The steel of the above basic alloy composition may further contain one or more of the alloying element or elements of the groups below:

I) one or more of Cr: up to 1.0%, Mo: up to 0.20% and Ni: up to 1.0%,

II) one or two of V: up to 0.30% and Nb: up to 0.10%, and

III) one or more of Pb: 0.01–0.20%, S: 0.005–0.30%, Bi: 0.01–0.10%, Te: 0.0005–0.10% and Ca: 0.0003–0.0050%.

DETAILED EXPLANATION OF THE PREFERRED EMBODIMENTS

The fine structure of ferrite crystal grain size number of 6 or more as defined by JIS-B0552 (which is equivalent to a mean sectional area of crystal grain of 0.00195 $mm^2$ can be attained by rolling the steel having one of the above alloy compositions at a relatively low temperature and under a high reduction of area. More specifically, the rolling is preferably carried out at a heating temperature up to 1,100° C., finishing temperature up to 950° C., and under a reduction of area of 70% or more.

The depth of decarburization of the rolled material (defined by JIS-G0588) is preferably up to DM-T:0.20 mm. If the depth of decarburization is too large, effect of the induction hardening will be slight and formation of the surface hardened layer is dissatisfactory, and further, deeper cutting will be necessary.

The following is the reasons for choosing the alloy compositions of the present invention as noted above:

C: 0.37–0.45%

Carbon content of 0.37% or more is necessary for maintaining the strength required for the structural parts. As the carbon content of the steel increases machinability and processability in form rolling decrease, and sensitivity of quenching crack and hardness due to rolling increase. Thus, a suitable content should be chosen in a range up to 0.45%.

Si: up to 0.35%

Silicon is used in a certain amount as a deoxidizer. In order to suppress increase in the hardness caused by rolling low, the amount of addition must be in the above limit.

Mn: 1.0–1.5%

To attain the induction hardenability manganese of 1.0% or more is necessary. On the other hand, increase of manganese content lowers machinability and processability in form rolling and heightens sensitivity of quench cracking. 1.5% is thus the upper limit.

B: 0.0005–0.0035%

Boron is important as the component improving hardenability without significant increase of hardness as rolled condition. The effect is appreciable at such a low content as 0.0005% or so, and saturates as the content increases. With a higher content of boron, hot workability becomes low, and therefore, the addition is limited to 0.0035% or less.

Ti: 0.01–0.05%,

Al: 0.01–0.06%

Both of the elements have a function of fixing nitrogen and oxygen contained in the material. Solid-dissolved nitrogen forms BN to decrease the hardenability-improving effect of boron. If, however, titanium or aluminum is contained, formation of TiN or AlN occurs preferentially and the effect of boron is thus maintained. For this purpose, addition of at least 0.01% of either element is necessary. On the other hand, too much addition is meaningless, and from consideration on the cleanliness of the steel, the upper limits of 0.05% for Ti and 0.06% for Al are set.

N: up to 0.22%

As noted above, nitrogen forms BN to prevent improvement in the hardenability, it is essential to limit the content of nitrogen to such an amount as not exceeding the equivalents to titanium and aluminum. It is not preferable to fix a large amount of nitrogen with a large amount of titanium, because this results in increase of TiN-based non-metallic inclusions.

The groups of alloying elements optionally added as mentioned above have the following effects, and limitations of the amounts of the elements are as follows:

One or more of Cr: up to 1.0%, Mo: up to 0.2% and Ni: up to 1.0%

Any of these elements may be used in the above noted limits when a further improvement of hardenability is desired. Too much addition not only results in no further increase of the effect, but also lowers the machinability and processability in form rolling.

One or two of V: up to 0.3% and Nb: up to 0.1%

These elements are added in case where further reduction of the crystal grain size is contemplated. Addition in the amounts exceeding the above limits will give no increase of the effect.

One or more of Pb: 0.01–0.20%, S: 0.005–0.30%, Bi: 0.01–0.10%, Te: 0.0005–0.10% and Ca: 0.0003–0.050%

Needless to say, these are the elements added in case where particularly high machinability is required. Addition in the amounts more than the lower limits will give the effect. The upper limits are set in view of deterioration of the mechanical properties of the steel.

The reason why the structure of the steel of the present invention must be of such fine grains as ferrite crystal grain size 6 or more is to ensure required toughness of the products.

EXAMPLES

Low temperature rolling was carried out on the alloy steels having the compositions shown in Table 1 under the condition of heating temperature 1,050° C., finishing temperature 850° C. and reduction of area 97% to prepare round rods of diameter 32 mm. (Only Control Run 5 was operated under the condition of heating temperature 1,250° C., and finishing temperature 1,050° C.)

The samples were subjected to the tests of the conditions shown below:

Ferrite Crystal Grain Size Number
JIS-G0552

Machinability: Drilling. When the drill abrades to cut no longer, the tool is regarded to come to the end of life.
Tool: SKH51, diameter 5 mm, 118°
Feed Rate: 0.1 mm/rev
Depth of Holes: 20 mm (blind hole)

Induction Hardenability
Test Piece: diameter 30 mm, length 100 mm
Frequency: 8 KHz
Out Put: 200 KW
Transfer Rate: 6 mm/sec
Effective Depth of Hardened Layer: Hv 400

Twist Strength
Test Piece: diameter 30 mm, length 450 mm

Toughness JIS-Z2242

The test results are shown in Table 2.

The data of Example runs in Table 2 show that the invented steels have such a good machinability that they can be directly cut or processed by form rolling without being annealed, and such a good hardenability that they may obtain a satisfactory hardness by induction hardening.

On the other hand, the data of control runs show that the control steels are inferior to the invented steels. (The underlines in Table 2 indicate the inferior properties.) In detail, Control No.1 has a hardened depth shallower than those of the invented steels owing to the lower Mn-content. Control No.2 exhibits a deep hardened depth and a high twist strength, however, the machinability is extremely low. Control No.3, which contains carbon in the amount smaller than the lower limit of the invention, has a very low twist strength. The increased nitrogen content of Control No.4, which is higher than those of the invented steels, results in a shallower hardened depth. Toughness of Control No.5 is lower than those of the invented steels because of the large ferrite grain size.

The steel, therefore, enables enjoying high productivity and low cost in production of various products inclusive of the above mentioned homokinetic joint.

TABLE 1

| No. | C | Si | Mn | S | B | Ti | Al | N | Others |
|---|---|---|---|---|---|---|---|---|---|
| | | | | | Example Runs | | | | |
| 1 | .42 | .25 | 1.05 | .016 | .0013 | .017 | .022 | .005 | |
| 2 | .39 | .13 | 1.30 | .021 | .0015 | .040 | .021 | .022 | Ni .10, Cr .05 |
| 3 | .38 | .09 | 1.45 | .035 | .0018 | .038 | .017 | .011 | |
| 4 | .42 | .23 | 1.03 | .025 | .0012 | .034 | .035 | .016 | Ni .07, Cr .50 |
| 5 | .44 | .31 | 1.18 | .022 | .0025 | .030 | .031 | .013 | Cr .12, Mo .09 |
| 6 | .41 | .25 | 1.05 | .013 | .0015 | .025 | .020 | .006 | Ni .85 |
| 7 | .39 | .23 | 1.04 | .028 | .0015 | .040 | .021 | .022 | Ni .10, Cr .05 V .15 |
| 8 | .37 | .25 | 1.22 | .034 | .0018 | .038 | .017 | .010 | Nb .02 |
| 9 | .41 | .20 | 1.08 | .024 | .0011 | .038 | .013 | .015 | Ni .04, Cr .11 Bi .06 |
| 10 | .42 | .04 | 1.45 | .028 | .0014 | .030 | .023 | .019 | Te .02 |
| 11 | .38 | .28 | 1.15 | .035 | .0015 | .028 | .011 | .008 | Mo .17, Ca .003 |
| 12 | .37 | .22 | 1.11 | .080 | .0020. | .042 | .019 | .018 | Ni .05, Cr .40 Mo .05, Pb .07 |
| | | | | | Control Runs | | | | |
| 1 | .40 | .24 | .60 | .018 | .0012 | .035 | .027 | .010 | Ni .01, Cr .10 Mo .02 |
| 2 | .41 | .23 | 1.80 | .018 | .0015 | .040 | .021 | .012 | Ni .02, Cr .09 Mo .01 |
| 3 | .33 | .21 | 1.23 | .018 | .0017 | .040 | .018 | .009 | Ni .02, Cr .07 Mo .01 |
| 4 | .42 | .25 | 1.13 | .025 | .0018 | .019 | .021 | .017 | Ni .02, Cr .05 Mo .01 |
| 5 | the same as Example Run No.1 (high temperature rolling) | | | | | | | | |

TABLE 2

| No. | Ferrite Crystal Grain No. | Effective Depth of Hardened Layer (mm) | Tool Life (relative value) | Twist Strength (kgf/mm$^2$) | Toughness (kgf-m/cm$^2$) | Mean Sectional Area of Crystal Grain mm$^2$ |
|---|---|---|---|---|---|---|
| | | | Example Runs | | | |
| 1 | 9.1 | 6.2 | 100 | 156 | 7.7 | 0.00023 |
| 2 | 8.6 | 7.3 | 80 | 170 | 6.4 | 0.00032 |
| 3 | 7.8 | 9.1 | 60 | 185 | 6.6 | 0.00056 |
| 4 | 6.6 | 7.8 | 70 | 173 | 6.0 | 0.00129 |
| 5 | 8.5 | 7.7 | 90 | 170 | 6.5 | 0.00035 |
| 6 | 7.8 | 9.1 | 60 | 190 | 8.2 | 0.00056 |
| 7 | 9.3 | 8.0 | 80 | 180 | 8.0 | 0.00020 |
| 8 | 9.5 | 7.9 | 80 | 180 | 8.2 | 0.00017 |
| 9 | 7.9 | 7.8 | 150 | 172 | 6.6 | 0.00052 |
| 10 | 9.1 | 9.0 | 90 | 182 | 7.1 | 0.00022 |
| 11 | 8.3 | 7.2 | 100 | 165 | 6.8 | 0.00040 |
| 12 | 7.6 | 7.1 | 200 | 161 | 6.9 | 0.00064 |

TABLE 2-continued

| No. | Ferrite Crystal Grain No. | Effective Depth of Hardened Layer (mm) | Tool Life (relative value) | Twist Strength (kgf/mm$^2$) | Toughness (kgf-m/cm$^2$) | Mean Sectional Area of Crystal Grain mm$^2$ |
|---|---|---|---|---|---|---|
| | | | Control Runs | | | |
| 1 | 8.1 | 4.5 | 200 | 121 | 8.0 | 0.00046 |
| 2 | 8.3 | 9.5 | 20 | 187 | 5.0 | 0.00040 |
| 3 | 8.1 | 7.4 | 180 | 115 | 8.2 | 0.00046 |
| 4 | 8.1 | 5.1 | 90 | 120 | 7.0 | 0.00046 |
| 5 | 5.1 | 6.1 | 120 | 131 | 4.5 | 0.00364 |

We claim:

1. A steel for induction hardening, which consists essentially of alloying elements, C: 0.37–0.45%, Si: up to 0.35%, Mn: more than 1.0% and up to 1.5%, B: 0.0005–0.0035%, Ti: 0.01–0.05% and Al: 0.01–0.06%, and the balance of Fe, the content of N being up to 0.022%, and has a fine structure of ferrite crystal grain size number of No. 6 or higher as defined by JIS-G0552.

2. A steel for induction hardening according to claim 1, wherein the steel, in addition to the alloying elements set forth in claim 1, further contains one or more of Cr: up to 1.0%, Mo: up to 0.20% and Ni: up to 1.0%.

3. A steel for induction hardening according to claim 1 an wherein the steel, in addition to the alloying elements set forth in claim 1, further contains one or two of V: up to 0.30% and Nb: up to 0.10%.

4. A steel for induction hardening according to claim 1, wherein the steel, in addition to the alloying elements set forth in claim 1, further further contains one or more of Pb: 0.01–0.20%, S: 0.005–0.30%, Bi: 0.01–0.10%, Te: 0.0005–0.10% and Ca: 0.0003–0.005%.

5. A steel for induction hardening according to claim 2, wherein the steel, in addition to the alloying elements set forth in claim 2, further contains one of two of V: up to 0.30% and Nb: up to 0.10%.

6. A steel for induction hardening according to claim 2, wherein the steel, in addition to the alloying elements set forth in claim 2, further contains one or more of Pb: 0.01–0.20%, S: 0.005–0.30%, Bi: 0.01–0.10%, Te: 0.0005–0.10% and Ca: 0.0003–0.005%.

7. A steel for induction hardening according to claim 3, wherein the steel, in addition to the alloying elements set forth in claim 3, further contains one or more of Pb: 0.01–0.20%, S: 0.005–0.30%, Bi: 0.01–0.10%, Te: 0.0005–0.10% and Ca: 0.0003–0.005%.

8. A steel for induction hardening, which consists essentially of allying elements, C: 0.37–0.45%, Si: up to 0.35%, Mn: 1.0–1.5%, B: 0.0005–0.0035%, TiP 0.01–0.05% and Al: 0.01–0.06%, and the balance of Fe, the content of N being up to 0.022%, said steel having a fine structure of ferrite crystal grain size as defined by JIS-G0552 of No. 6 or hither and being prepared by rolling at a temperature of up to 1,100° C., finishing at a temperature of up to 950° C., and under a reduction of area of 70% or more.

* * * * *